US007766457B2

(12) United States Patent
Chen

(10) Patent No.: US 7,766,457 B2
(45) Date of Patent: Aug. 3, 2010

(54) INK-JET HEAD AND PRINTER USING THE SAME

(75) Inventor: Yen-Chih Chen, Taipei Hsien (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 553 days.

(21) Appl. No.: 11/836,734

(22) Filed: Aug. 9, 2007

(65) Prior Publication Data

US 2009/0002454 A1 Jan. 1, 2009

(30) Foreign Application Priority Data

Jun. 29, 2007 (CN) ..... 2007 1 0076259

(51) Int. Cl.
*B41J 2/06* (2006.01)
*B41J 2/165* (2006.01)

(52) U.S. Cl. ..... 347/55; 347/29

(58) Field of Classification Search ..... 347/55, 347/54, 56–59, 61–63, 65, 50, 44, 20, 14, 347/9, 5

See application file for complete search history.

(56) References Cited

U.S. PATENT DOCUMENTS

| | | | | |
|---|---|---|---|---|
| 6,227,651 | B1 * | 5/2001 | Watts et al. | 347/50 |
| 2006/0125874 | A1 * | 6/2006 | Lee et al. | 347/33 |
| 2007/0024669 | A1 | 2/2007 | Sugahara | |

FOREIGN PATENT DOCUMENTS

| | | | |
|---|---|---|---|
| CN | 2735342 | Y | 10/2005 |
| EP | 1738911 | A2 | 1/2007 |

* cited by examiner

*Primary Examiner*—K. Feggins
(74) *Attorney, Agent, or Firm*—Jeffrey T. Knapp

(57) ABSTRACT

A printer (100) includes an ink tank (20), an ink-jet head (10), and a tube (30) connecting the ink tank with the ink-jet head. The ink-jet head includes a top plate (14) and a bottom plate (12). The bottom plate defines an ink storage pool (122) and an ink channel (124) therein. The top plate includes a plurality of control electrodes (142*a*, 142*b*, 142*c*). One end of the ink channel communicates with the ink storage pool, and the other end of the ink channel includes an ink muzzle (124*a*). A portion of the control electrode (142*a*) extends over the ink storage pool. The control electrodes are applied with impulse voltages to drive ink in the ink storage pool to move towards the ink muzzle along the ink channel.

12 Claims, 10 Drawing Sheets

INK-JET HEAD AND PRINTER USING THE SAME

BACKGROUND OF THE INVENTION

1. Field of the Invention

The present invention relates generally to ink-jet heads, and more particularly to an ink-jet head controlling ink movement via EWOD (electrowetting-on-dielectric) effect, and a printer using such an ink-jet head.

2. Description of Related Art

In the developments in electronic areas, inkjet printers appear upon improvement of dot-matrix printers. Bubble-jet printers and piezoelectric printers are two kinds of inkjet printers. The bubble-jet printer includes a heater, which vaporizes the ink into a plurality of bubbles. The bubbles drive the ink jetting from a muzzle of the bubble-jet printer and printing on a paper. The piezoelectric printer has a piezoelectric element placed adjacent to a muzzle thereof. When the piezoelectric element deforms under different voltages applied thereon, the muzzle of the piezoelectric printer is pressed by the piezoelectric element and the ink is printed on a paper.

In the bubble-jet and piezoelectric printers, a plurality of complicated tiny channels are formed in ink-jet heads thereof. The ink flows through the tiny channels and is printed on the paper via the muzzles. However, flow resistances generated by the tiny channels lowers jetting speed and jetting quality of the ink. Thus, the tiny channels need to be precisely manufactured to have smooth surfaces so as to decrease the flow resistances. This increases manufacturing cost of the bubble-jet and piezoelectric printers. Therefore, it is need to provide a printer having good ink-jet quality but lower manufacturing cost.

SUMMARY OF THE INVENTION

The present invention relates, in one aspect, to an ink-jet head for a printer. The ink-jet head includes a top plate and a bottom plate. The top plate embeds a plurality of control electrodes therein. The bottom plate defines an ink storage pool and an ink channel therein. One end of the ink channel communicating with the ink storage pool, and the other end of the ink channel includes an ink muzzle. A portion of the control electrodes of the top plate extends into the ink storage pool of the bottom plate. The control electrodes are applied on impulse voltages to drive ink in the ink storage pool to move towards the ink muzzle along the ink channel.

The present invention relates, in another aspect, to a printer using the ink-jet head. The printer includes an ink tank, an ink-jet head, and a tube connecting the ink tank with the ink-jet head. The ink-jet head includes a top plate and a bottom plate. The bottom plate defines an ink storage pool and an ink channel therein. One of the top plate and the bottom plate includes a plurality of control electrodes. One end of the ink channel communicates with the ink storage pool, and the other end of the ink channel includes an ink muzzle. A portion of the control electrodes extends into the ink storage pool of the bottom plate. The control electrodes are applied on impulse voltages to drive ink in the ink storage pool to move towards the ink muzzle along the ink channel.

Other advantages and novel features of the present invention will become more apparent from the following detailed description of preferred embodiments when taken in conjunction with the accompanying drawings, in which:

DETAILED DESCRIPTION OF THE INVENTION

Figure 1:
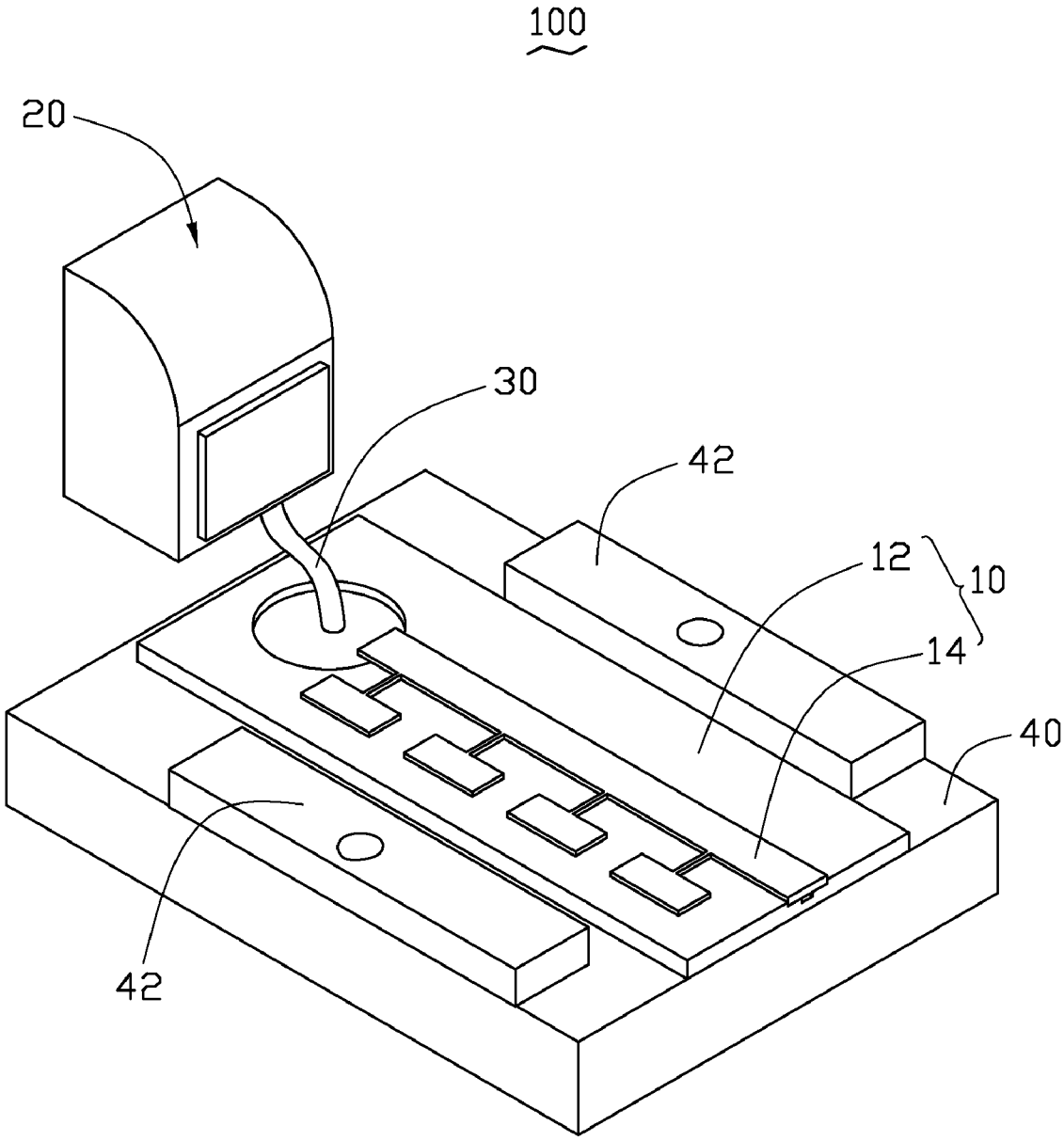
FIG. 1 is an explanation view of a printer in accordance with a preferred embodiment of the present invention.

Reference will now be made to the drawing figures to describe the preferred embodiment in detail.

Referring to FIG. 1, a printer 100 according to a preferred embodiment of the present invention is shown. The printer 100 includes a plurality of ink-jet heads 10 (only one is shown in the drawings), an ink tank 20, a tube 30 and a base plate 40. The base plate 40 includes two blocks 42 at two opposite sides thereof. The ink-jet head 10 is mounted on the base plate 40 and sandwiched between the blocks 42.

Figure 2:
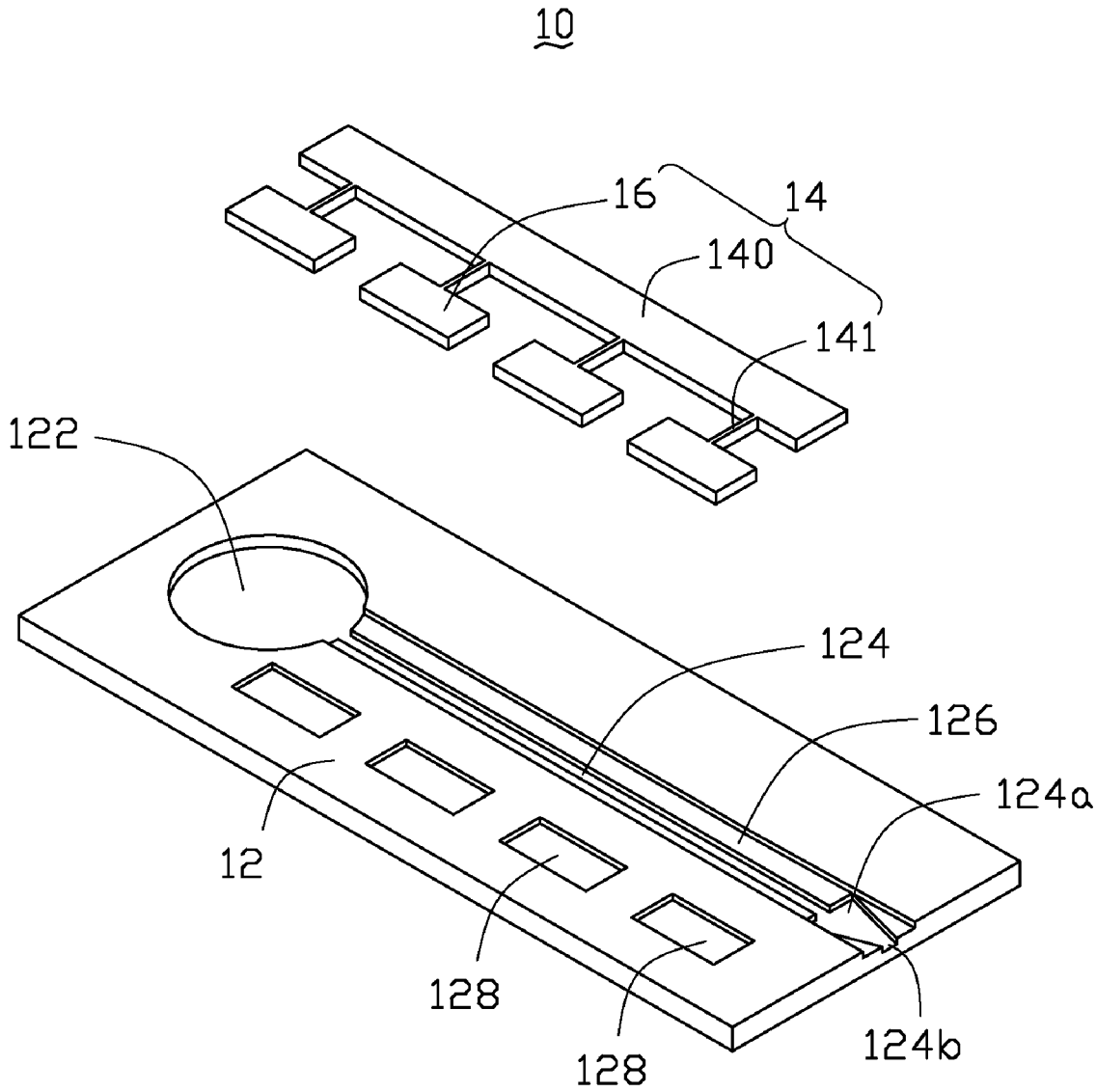
FIG. 2 is an exploded, isometric view of an ink-jet head of the printer of FIG. 1.

Referring to FIG. 2, the ink-jet head 10 includes a top plate 14 and a bottom plate 12. The bottom plate 12 defines an ink storage pool 122 for accommodating ink therein. The ink tank 20 is connected to the ink storage pool 122 via the tube 30 so that the ink stored in the ink tank 20 can flow towards the ink storage pool 122 via the tube 30.

The bottom plate 12 is rectangular shaped in profile. The ink storage pool 122 is located adjacent to one end of the bottom plate 12. The bottom plate 12 defines an elongate ink channel 124 communicating with the ink storage pool 122. The ink channel 124 extends lengthwise from an end, which communicates with the ink storage pool 122, towards an opposite end thereof. A width of the opposite end of the ink channel 124 gradually decreases along the extension direction thereof. An arrowheaded ink muzzle 124*a* is accordingly formed at the opposite end of the ink channel 124. A width of a cusp 124*b* of the ink muzzle 124*a* is smaller than that of the ink channel 124. The ink is jetted from the ink muzzle 124*a* to a paper (not shown) via the cusp 124*b*.

The bottom plate 12 forms two steps at two sides of the ink channel 124, respectively. A receiving channel 126 is accordingly formed at a top portion of the bottom plate 12 and above the ink channel 124. The bottom plate 12 defines a plurality of spaced indents 128 at one side of the ink channel 124.

Figure 3:
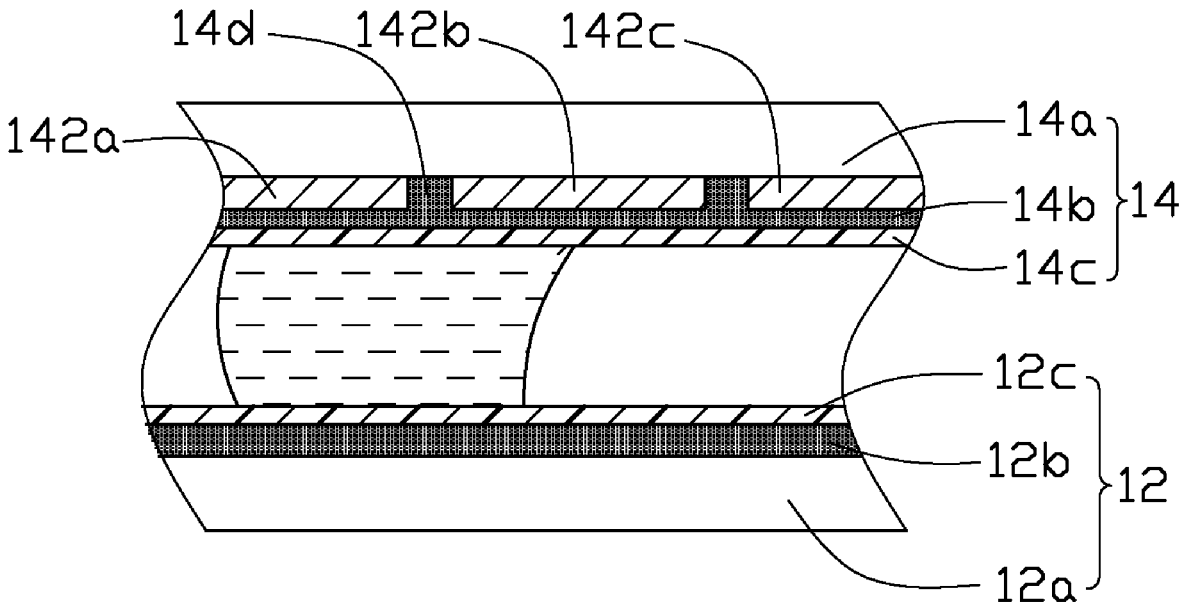
FIG. 3 is a part of a cross-sectional view of the ink-jet head of FIG. 2, showing the part corresponding to an ink channel of the ink-jet head.

Referring to FIG. 3, as viewed from the cross-sectional view, the bottom plate 12 includes a substrate 12*a* made of ITO (indium tin oxide) glass. The ink storage pool 122, the ink channel 124, the receiving channel 126 and the indents 128 are defined in the bottom plate 12 by recessing a top surface of the substrate 12*a*. A dielectric layer 12*b* is deposited on the top surface of the substrate 12*a* via plasma enhanced chemical vapor deposition method. The dielectric layer 12*b* is a silicone nitride ($Si_3N_4$) layer having a thickness of 400 to 500 nm. A hydrophobic layer 12*c* made of Teflon AF1200 is coated on the dielectric layer 12*b* via spin coating method, so that the ink can not permeate into the bottom plate 12.

Referring to FIGS. 2 and 3, the top plate 14 includes an elongated electrode plate 140 embedded with a plurality of spaced control electrodes therein (only three control electrodes 142*a*, 142*b*, 142*c* are shown in FIG. 3), a plurality of connecting units 141 connected with the control electrodes 142*a*, 142 *b*, 142*c*, and a plurality of electric terminals 16 electrically connected with the control electrodes 142*a*, 142*b*, 142*c* via the connecting units 141. The electric terminals 16 electrically connect with a control circuit (not shown), and transfer pulse voltage from the control circuit to the control electrodes 142*a*, 142*b*, 142*c*. When the top plate 14 is assembled to the bottom plate 12, the electric terminals 16 are received in the indents 128 of the bottom plate 12 and electrically communicate with the control circuit. The electrode plate 140 of the top plate 14 is received in the receiving channel 126 of the bottom plate 12, with a left end of the control electrode 142*a*, as viewed from the drawings, extending over a part of the ink storage pool 122.

Figure 4A:
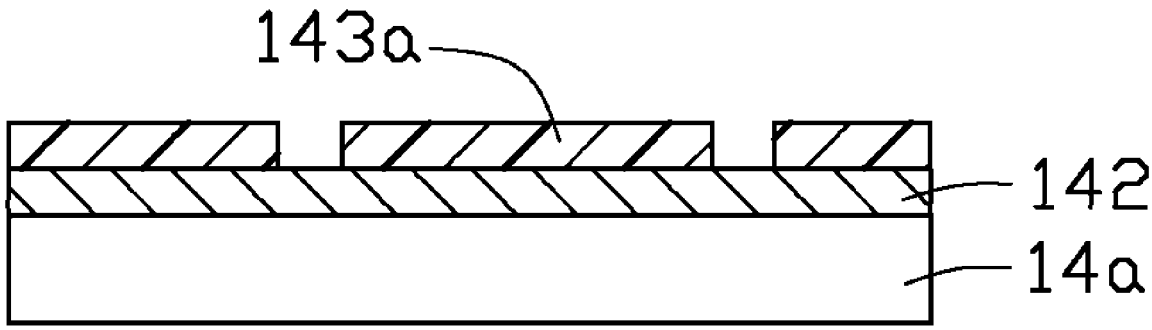
FIG. 4A-4D are explanation views of steps for manufacturing a top plate of the ink-jet head of FIG. 3.
Figure 4B:
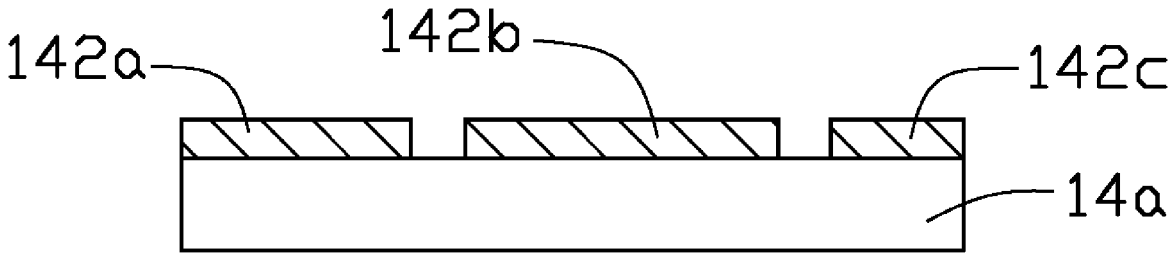
Figure 4C:
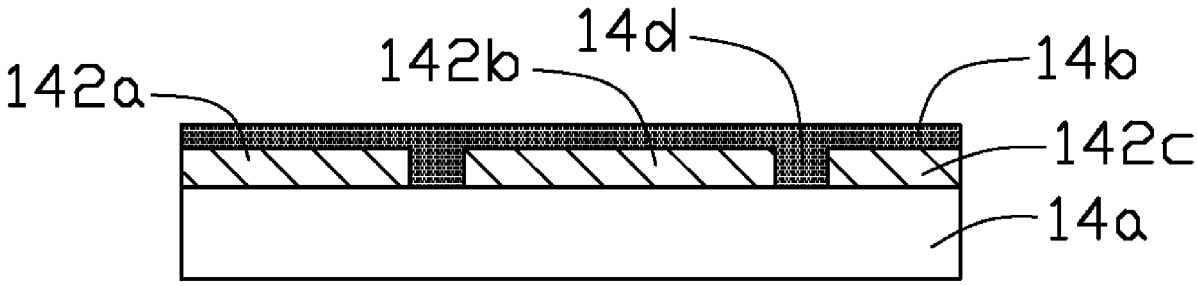
Figure 4D:
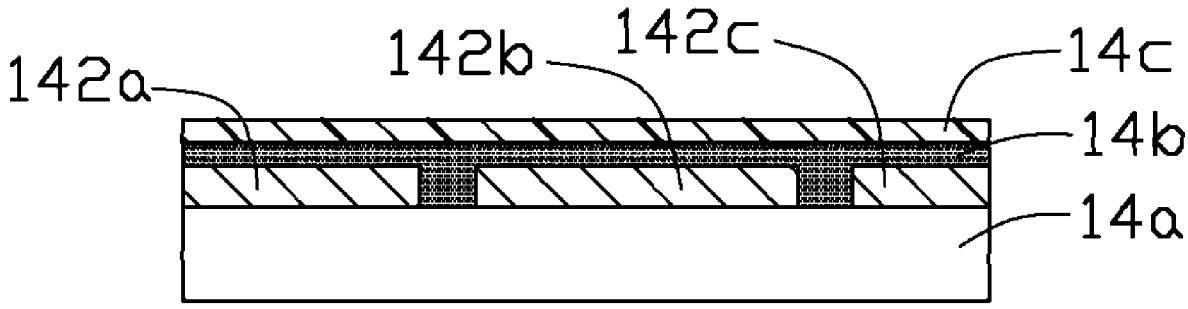

Particularly referring to FIG. 3, the top plate 14 includes a substrate 14*a* made of ITO glass. FIGS. 4A-4D show steps of manufacturing of the top plate 14, wherein details thereof are described below. Referring to FIG. 4A, a conductive layer 142 is formed on the substrate 14*a*. A layer of photo resist 143*a* is spread on some predetermined portions of the conductive layer 142. Referring to FIG. 4B, the portions of the conductive layer 142 without the photo resist 143*a* are etched via photochemical etching method, and the photo resist 143*a* on the conductive layer 142 is removed. The remaining portions of the conductive layer 142 form the control electrodes 142*a*, 142*b*, 142*c*. Referring to FIG. 4C, a dielectric layer 14*b* is deposited on surfaces of the substrate 14*a* and the control electrodes 142*a*, 142*b*, 142*c* via plasma enhanced chemical vapor deposition method. A plurality of dielectric spots 14*d* are formed between adjacent control electrodes 142*a*, 142*b* and 142*b*, 142*c*. The control electrodes 142*a*, 142*b*, 142*c* are electrically isolated from each other via the dielectric spots 14*d*. Referring to FIG. 4D, a hydrophobic layer 14*c* made of Teflon AF1200 is coated on the dielectric layer 14*b* via spin coating method, so that the ink can not permeate into the top plate 14.

Figure 5A:
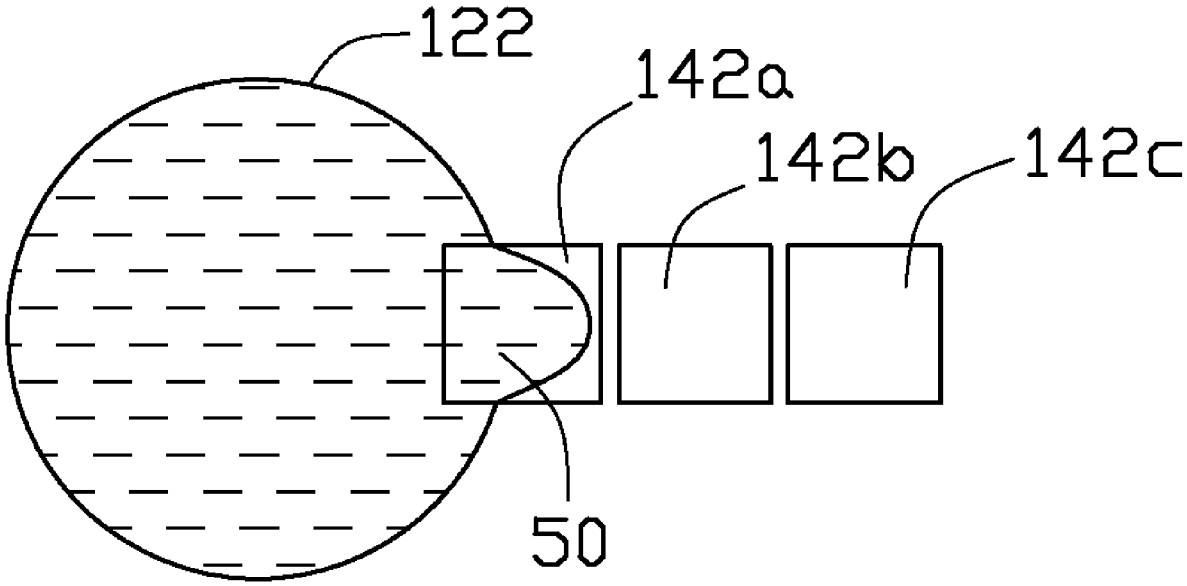
FIG. 5A-5C are explanation views of an operation process of the printer.
Figure 5B:
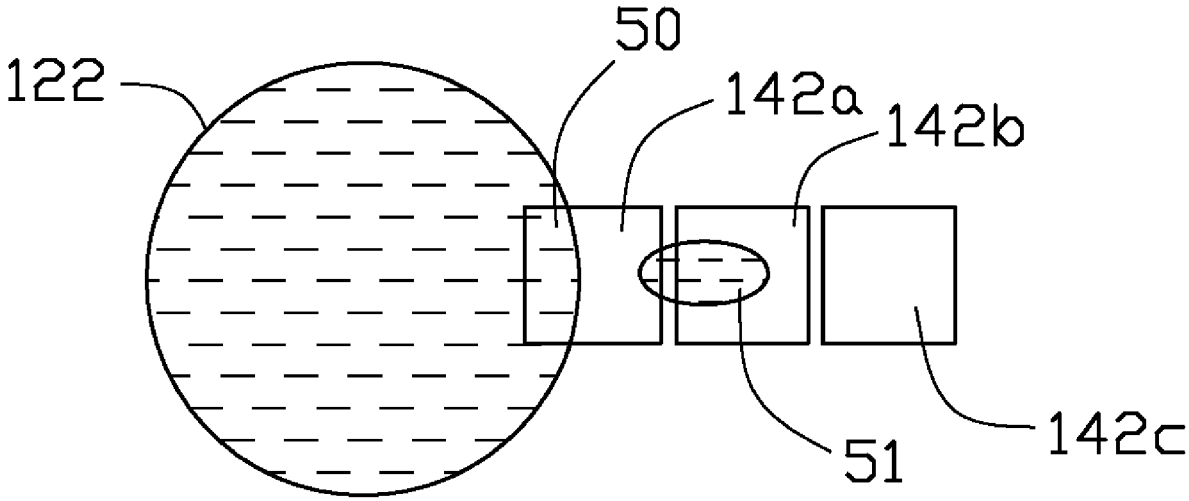
Figure 5C:
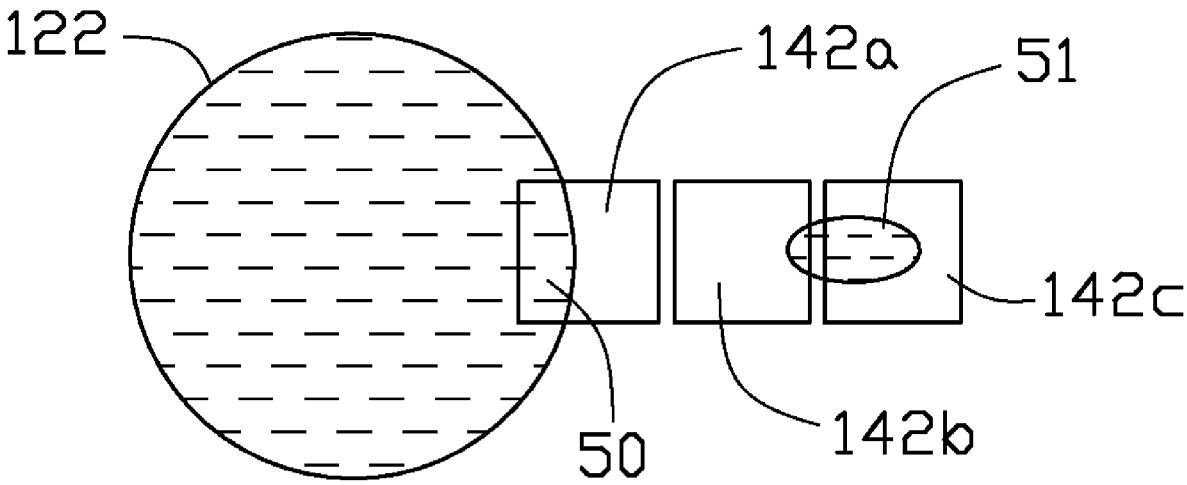

Referring to FIGS. 5A to 5C, during operation of the printer 100, the ink flows from the ink tank 20 towards the ink storage pool 122 via the tube 30. The dielectric layer 12*b* of the bottom plate 12 is in ground electric potential. The control electrode 142*a* is applied with the impulse voltage from the control circuit. Therefore, the surface tension of a front side (right side as viewed from FIG. 5A) of an ink segment 50 located below the control electrode 142*a* varies due to EWOD (electrowetting-on-dielectric) effect. The EWOD effect is a phenomenon that a contact angle of a front or a rear side of a fluid segment or a fluid droplet varies when a voltage is applied on the front or the rear side of the fluid droplet, whilst a contact angle of the other side of the fluid segment/the fluid droplet is remained as before. Therefore, the contact angles of the front and rear sides of the fluid segment/the fluid droplet is different from each other, which causes the surface tensions of the front and rear sides of the fluid segment/the fluid droplet to be different. The difference between the surface tensions drives the ink segment 50 to move towards a place having a higher voltage (Referring to FIG. 5A). That is, the ink segment 50 moves from the ink storage pool 122 towards a portion of the ink channel 124 corresponding to the control electrode 142*a*. The control electrode 142*b* is then applied with the impulse voltage from the control circuit. The ink segment 50 further moves from the portion of the ink channel 124 corresponding to the control electrode 142*a* towards a portion of the ink channel 124 corresponding to the control electrode 142*b*. When the front side of the ink segment 50 arrives at the portion of the ink channel 124 corresponding to the control electrode 142*b*, the voltage applied on the control electrode 142*a* is cut off. A small ink droplet 51 is formed from the ink segment 50 under the action of the different surface tensions thereof (Referring to FIG. 5B). The control electrode 142*c* is then applied with the impulse voltage from the control circuit. The ink droplet 51 moves from the portion of the ink channel 124 corresponding to the control electrode 142*b* towards a portion of the ink channel 124 corresponding to the control electrode 142*c*. When a front side of the ink droplet 51 arrives at the portion of the ink channel 124 corresponding to the control electrode 142*c*, the voltage applied on the control electrode 142*b* is cut off. Finally, the ink droplet 51 moves towards the ink muzzle 124*a* and jets out of the printer 100 via the cusp 124*b* of the ink muzzle 124*a*. The ink droplet 51 is therefore printed on the paper (not shown). The aforesaid description only shows a movement of an ink droplet 51; actually, there are a plurality of ink droplets 51 simultaneously moving along the ink channel 124 when the control electrodes 142*a*, 142*b*, 142*c* are alternately turned on and off. Thus, a required drawing or text can be printed on the paper according to the received data of the printer 100.

In the present printer 100, the width of the ink muzzle 124*a* gradually decreases along a movement direction of the ink droplet 51. When the ink droplet 51 arrives at the cusp 124*b* of the ink muzzle 124*a*, it is pressed inwardly to have a very small diameter. Therefore, the ink droplet 51 can easily conquer the surface attraction formed between surfaces of the cusp 124*b* and the ink droplet 51 to be jetted away from the printer 100. The present printer 100 controls the movement of the ink droplet 51 via varying the surface tensions of the ink droplet 51. In the movement of the ink droplet 51, a flow resistance generated between surfaces of the ink channel 124 and the ink droplet 51 is conquered by the surface tensions of the ink droplet 51 generated from the EWOD effect. Therefore, there is no need to form a smooth, tiny ink channel in the bottom plate 12 to decrease the flow resistance. This simplifies the manufacture of the printer 100 and enables the printer 100 to be mass-produced. Therefore, the printer 100 has a low manufacturing cost.

It is to be understood, how ever, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ink-jet head comprising:

a top plate embedded with a plurality of control electrodes therein; and a bottom plate defining an ink storage pool and an ink channel therein, one end of the ink channel communicating with the ink storage pool, and another end of the ink channel comprising an ink muzzle, a portion of one of the control electrodes of the top plate extending over the ink storage pool of the bottom plate, the control electrodes being applied with impulse voltages to drive ink in the ink storage pool to move towards the ink muzzle along the ink channel.

2. The ink-jet head as described in claim 1, wherein the ink muzzle is arrowheaded in profile, and a width of a cusp of the ink muzzle is smaller than that of the ink channel.

3. The ink-jet head as described in claim 1, wherein the top plate comprises an electrode plate which is embedded with the control electrodes therein, the bottom plate defining a receiving channel above the ink channel, the receiving channel receiving the electrode plate of the top plate therein.

4. The ink-jet head as described in claim 1, wherein the top plate comprises a plurality of electric terminals electrically connected with the control electrodes, and the bottom plate defines a plurality of indents, receiving the electric terminals therein.

5. The ink-jet head as described in claim 1, wherein each of the top plate and the bottom plate comprises a substrate, a dielectric layer spread on the substrate, and a hydrophobic layer spread on the dielectric layer, the hydrophobic layers of the top plate and the bottom plate being respectively arranged on top and bottom sides of the ink channel.

6. The ink-jet head as described in claim 5, wherein the dielectric layer of the top plate comprises a plurality of dielectric spots disposed between adjacent ones of the control electrodes, the control electrodes being separated from each other by the dielectric spots.

7. A printer comprising:

an ink tank;

an ink-jet head comprising:

a top plate; and a bottom plate defining an ink storage pool and an ink channel therein, one of the top plate and the bottom plate comprising a plurality of control electrodes, one end of the ink channel communicating with the ink storage pool, and another end of the ink channel comprising an ink muzzle, a portion of one of the control electrodes extending over the ink storage pool of the bottom plate, the control electrodes being applied with impulse voltages to drive ink in the ink storage pool to move towards the ink muzzle along the ink channel; and a tube connecting the ink tank with the ink storage pool of the ink-jet head.

8. The printer as described in claim 7, wherein the ink muzzle is arrowheaded in profile, and a width of a cusp of the ink muzzle is smaller than that of the ink channel.

9. The printer as described in claim 7, wherein the top plate comprises an electrode plate in which the control electrodes are embedded, the bottom plate defining a receiving channel above the ink channel, the receiving channel receiving the electrode plate of the top plate therein.

10. The printer as described in claim 7, wherein the top plate comprises a plurality of electric terminals electrically connected with the control electrodes, and the bottom plate defines a plurality of indents receiving the electric terminals therein.

11. The printer as described in claim 7, wherein each of the top plate and the bottom plate comprises a substrate, a dielectric layer spread on the substrate, and a hydrophobic layer spread on the dielectric layer, the hydrophobic layers of the top plate and the bottom plate being respectively arranged on top and bottom sides of the ink channel.

12. The printer as described in claim 11, wherein the control electrodes are embedded in the top plate and the dielectric layer of the top plate comprises a plurality of dielectric spots disposed between adjacent ones of the control electrodes, the control electrodes being separated from each other by the dielectric spots.

* * * * *